US011611151B2

(12) United States Patent
Plet et al.

(10) Patent No.: US 11,611,151 B2
(45) Date of Patent: Mar. 21, 2023

(54) MULTIBAND ANTENNA STRUCTURE

(71) Applicant: NOKIA SHANGHAI BELL CO., LTD., Shanghai (CN)

(72) Inventors: Jerome Plet, Louannec (FR); Zied Charaabi, Lannion (FR); Thomas Julien, Lannion (FR); Jean-Pierre Harel, Lannion (FR); Aurelien Hilary, Paimpol (FR)

(73) Assignee: NOKIA SHANGHAI BELL CO., LTD., Shanghai (CN)

( * ) Notice: Subject to any disclaimer, the term of this patent is extended or adjusted under 35 U.S.C. 154(b) by 9 days.

(21) Appl. No.: 17/256,925

(22) PCT Filed: Jun. 29, 2018

(86) PCT No.: PCT/US2018/040486
§ 371 (c)(1),
(2) Date: Dec. 29, 2020

(87) PCT Pub. No.: WO2020/005298
PCT Pub. Date: Jan. 2, 2020

(65) Prior Publication Data

US 2021/0288414 A1 Sep. 16, 2021

(51) Int. Cl.
*H01Q 21/00* (2006.01)
*H01Q 1/42* (2006.01)
(Continued)

(52) U.S. Cl.
CPC ..... *H01Q 21/0025* (2013.01); *H01Q 1/42* (2013.01); *H01Q 19/136* (2013.01); *H01Q 21/26* (2013.01); *H01Q 21/28* (2013.01); *H01Q 25/001* (2013.01)

(58) Field of Classification Search
CPC .... H01Q 21/0025; H01Q 21/26; H01Q 21/28; H01Q 1/42; H01Q 19/136; H01Q 25/001; H01Q 5/40; H01Q 1/246
See application file for complete search history.

(56) References Cited

U.S. PATENT DOCUMENTS 6,650,291 B1 11/2003 West et al.
2005/0237258 A1 10/2005 Abramov et al.
(Continued)

FOREIGN PATENT DOCUMENTS

CN 102918705 2/2013
CN 203813033 9/2014
(Continued)

*Primary Examiner* — Hoang V Nguyen
(74) *Attorney, Agent, or Firm* — Capitol Patent & Trademark Law Firm, PLLC

(57) ABSTRACT

An active passive antenna arrangement as made up of an array of 5G antennas interleaved with multiband antenna structures that may be low band (LB) passive antennas. The 5G antenna array may be a mMIMO active array. The LB antennas are formed using conductive elements on thin supporting sheets that fit within the space between the 5G antennas. The substrates, and hence the radiating elements of the LB antennas, may be arranged so as to generally appear to form four sides of a rectangular box with the top and bottom surfaces removed. Thus, the LB antennas may be thought of as having been "slipped in" amongst a preexisting array of 5G antennas. Each LB antenna may surround one or more of the 5G antennas and 5G antennas of the array may also be external to an LB antenna.

20 Claims, 8 Drawing Sheets

(51) Int. Cl.

| | |
|---|---|
| ***H01Q 19/13*** | (2006.01) |
| ***H01Q 21/26*** | (2006.01) |
| ***H01Q 21/28*** | (2006.01) |
| ***H01Q 25/00*** | (2006.01) |

(56) References Cited

U.S. PATENT DOCUMENTS

| | | | | |
|---|---|---|---|---|
| 2010/0097286 | A1 | 4/2010 | Morrow et al. | |
| 2012/0146872 | A1 | 6/2012 | Chainon et al. | |
| 2013/0271336 | A1 | 10/2013 | Plet et al. | |
| 2015/0070234 | A1 | 3/2015 | Jones | |
| 2016/0248166 | A1 | 8/2016 | Moon et al. | |
| 2018/0145424 | A1* | 5/2018 | Puente Baliarda .. | H01Q 21/062 |

FOREIGN PATENT DOCUMENTS

| | | | | |
|---|---|---|---|---|
| CN | 206516753 U * | 9/2017 | ..... | H01Q 1/38 |
| EP | 3179634 | 6/2017 | | |
| WO | WO 2012/055883 | 5/2012 | | |
| WO | WO-2018046086 A1 * | 3/2018 | ..... | H01Q 1/246 |

* cited by examiner

MULTIBAND ANTENNA STRUCTURE

This application claims benefit of International Application Number PCT/US2018/040486 filed on 29 Jun. 2018 entitled MULTIBAND ANTENNA STRUCTURE. The content of the foregoing application is incorporated herein by reference.

TECHNICAL FIELD

This disclosure relates to antennas, and more particularly, to adding a new type of antenna array to be used to provide a wireless service using space already used by an existing antenna array to provide a different wireless service.

BACKGROUND

Acquiring new sites to place the antennas necessary for providing wireless service, especially for a wireless service that requires a new type of antenna, has become almost impossible in most dense urban areas. Also, the addition of new antennas supporting new frequency bands can result in very long, painful, and expensive negotiations with site owners. As a result, the deployment of active antennas systems (AAS), a key enabler of so-called "fifth generation (5G)" wireless service, will likely be a major challenge for mobile network operators. Given the foregoing, it is desirable to find ways to add new antennas onto already crowded sites, especially rooftops.

SUMMARY

We have recognized that the installation issues can be avoided, in accordance with the principles of the disclosure, by the use of an arrangement which interleaves an array of 5G antennas amongst multiband antenna structures. In accordance with an aspect of the disclosure, the multiband antenna structures may be passive antennas. In accordance with an aspect of the disclosure, the multiband antenna structures may be low band (LB) antennas. In accordance with an aspect of the disclosure, the 5G antennas may be arranged as a massive multiple-input multiple-output (mMIMO) array. The mMIMO array may be an active array. In such a case, where the 5G antenna array is an active array and the LB antenna array is a passive array, the overall configuration may be referred to as an active passive antenna (APA) arrangement.

In accordance with an aspect of the disclosure, such an interleaved arrangement of antennas may employ low band (LB) antennas that are formed using conductive elements, including, for example, feeders and radiators, on thin supporting sheets. The supporting sheets are oriented so that at least one of their dimensions, e.g., their thinnest dimension, fits within the limited physical space between the 5G antennas. In accordance with an embodiment of the disclosure, one or more of the supporting sheets, which act as a substrate to which the conductive elements are affixed, may be, for example, a printed circuit board. The substrates may be arranged so as to generally appear to form four sides of a hollow rectangular parallelepiped, e.g., four sides of a hollow cuboid, which may have various protrusions and cutouts, where the missing two sides, which are open, may be considered to be the top and bottom sides of the cuboid, where the bottom side is closest to the plane from which the signals are supplied to the antennas. In other words, the substrates for the radiating elements of the LB antennas may be shaped to appear like an empty rectangular box with the top and bottom surfaces removed. The missing bottom surface is in the area from which the 5G antennas receive their signal to transmit, e.g., near the chassis level, and the lack of the opposing top surface allows signals from the 5G antennas to radiate outward.

Herein, the terms top and bottom are to be construed irrespective of the position of the structure in space with respect to a horizontal plane.

The positions, dimensions, and heights of each LB and 5G radiating element are set based on desired radio frequency (RF) performance of the LB and 5G arrays. Thus, the LB antennas may be thought of as having been "slipped in" amongst a preexisting array of 5G antennas and each LB antenna may surround one or more of the 5G antennas. In embodiments of the disclosure, portions of one or more of the substrates may be removed or missing.

In embodiments of the disclosure, the physical dimensions of each of the substrates of at least one of the LB antennas are substantially the same. In other words, the LB antennas, when viewed from the top, appear to be substantially square-like, i.e., having a square cross-section.

In embodiments of the disclosure, the radiating elements of the LB antennas are electrically arranged to form an arrangement of dipoles. These low band (LB) radiating elements may be passive or active, depending on the embodiment.

The 5G antennas may be located atop pillars so as to bring them to an appropriate height, e.g., with respect to the LB antennas. Thus, the 5G antennas may have their tops below, at the same level as, or above the plane of the missing top surface of the LB antennas.

In embodiments of the disclosure, each 5G antenna may be formed of at least one dipole. In some embodiments, two dipoles oriented at 90 degrees from each other are used to make up the 5G antenna. In embodiments of the disclosure, each 5G antenna may be coupled to a filter. In embodiments of the disclosure, such filters may be incorporated into stands or pillars on which the 5G antennas sit.

Some embodiments feature an antenna array, comprising:

a two dimensional array of multiband antennas;

a two dimensional array of fifth generation—5G-antennas for broadband cellular networks;

wherein at least some of the 5G antennas are interleaved amongst the multiband antennas.

In some specific embodiments at least one of the multiband antennas are each shaped like a hollow parallelepiped with two opposing surfaces missing, wherein one of the missing surfaces is proximal to a source of a signal that is supplied to the at least to one LB antenna to be transmitted therefrom and the opposing missing surface is distal to the signal source.

In some specific embodiments the hollow parallelepiped is a cuboid.

In some specific embodiments the hollow parallelepiped comprises support walls each of which fit within a gap between at least two of the 5G antennas.

In some specific embodiments at least one of the support walls has a conductor for radiating therefrom.

In some specific embodiments the multiband antennas are low band (LB) antennas.

In some specific embodiments the multiband antennas are passive antennas.

In some specific embodiments the 5G antennas are arranged as an N×M×2 element array where N is an integer greater than or equal to 1 that corresponds to the number of columns of antennas, M is an integer greater than or equal to 1 that corresponds to the number of rows of antennas, and 2 corresponds to the number of cross polarized channels of each 5G antenna.

In some specific embodiments at least one of the 5G antennas is mounted on a stand.

In some specific embodiments at least one of the 5G antennas is mounted on a stand that feeds at least one signal to be radiated by the at least one 5G antenna to the at least one 5G antenna.

In some specific embodiments at least one of the 5G antennas is mounted on a stand that feeds at least one signal to be radiated by the at least one 5G antenna to the at least one 5G antenna and wherein the stand incorporates a filter element through which the at least one signal passes.

In some specific embodiments at least one of 5G antennas is mounted above a reflector.

In some specific embodiments at least one of 5G antenna elements is mounted above a reflector that has an open at its base, hollow, truncated inverted pyramid shape.

In some specific embodiments the 5G antennas are arranged as a massive multiple input multiple output (mMIMO) antenna array.

In some specific embodiments at least one of the 5G antennas is located within one of the multiband antennas and wherein at least one of the 5G antennas is located between two of the 5G antennas.

Some embodiments feature an antenna array, comprising:

a two dimensional array of multiband antenna structures;

a two dimensional array of fifth generation—5G-antenna elements for broadband cellular networks having a regular spacing between each of the 5G antenna elements;

wherein at least some of the 5G antenna elements are interleaved amongst the multiband antenna structures such that support structures and radiators thereon for each of the two dimensional array of multiband antenna structures fit within space provided by the regular spacing of the two dimensional array of 5G antenna elements.

In some specific embodiments the two dimensional array of 5G antennas are spaced apart from each other only by a distance substantially in conformity with a thickness of the support structures of the multiband antenna structures so as to allow the multiband antenna structures to fit within said space.

Some embodiments feature a multiband antenna comprising:

four printed circuit boards that are joined to form a hollow rectangular box with its top and bottom missing;

conductive material forming on a respective first surface of at least some of the printed circuit boards first and second vertical conductive legs and a horizontal radiating conductor therebetween, each of the vertical conductive legs being connected at their respective end distal from the horizontal radiating conductor to ground, each said first surface facing exteriorly to the hollow rectangular box;

a respective feed conductor formed on a second surface, opposite to said respective first surface, of the at least some of the printed circuit boards, each said second surface facing interiorly to the hollow rectangular box, each of the feed conductors being located opposite to the first vertical conductive leg and extending behind the first vertical conductive leg substantially a length of the first vertical conductive leg, each of the feed conductors being couplable to a signal source at an end thereof distal to the horizontal radiating conductor coupled to its first vertical leg;

a conductive connection between another end of each respective feed conductor and the horizontal radiating conductor of the one of the printed circuit boards immediately adjacent thereto.

In some specific embodiments the printed circuit boards are joined so that at least a portion of each printed circuit board protrudes through at least one of its adjacent printed circuit boards.

In some specific embodiments each respective conductive connection is located above each respective second leg.

In some specific embodiments at least one fifth generation (5G) antenna is located within the area defined by the hollow rectangular box and at least one 5G antenna is exterior to the area defined by the hollow rectangular box.

In some specific embodiments the 5G antennas are part of massive multiple input multiple output (mMIMO) active antenna array.

In some specific embodiments the spacing between the 5G antennas are substantially adjacent and are spaced apart by a distance substantially in conformity with a thickness of the printed circuit boards so as to allow the multiband antenna structures to fit within said space.

DETAILED DESCRIPTION

Figure 1:
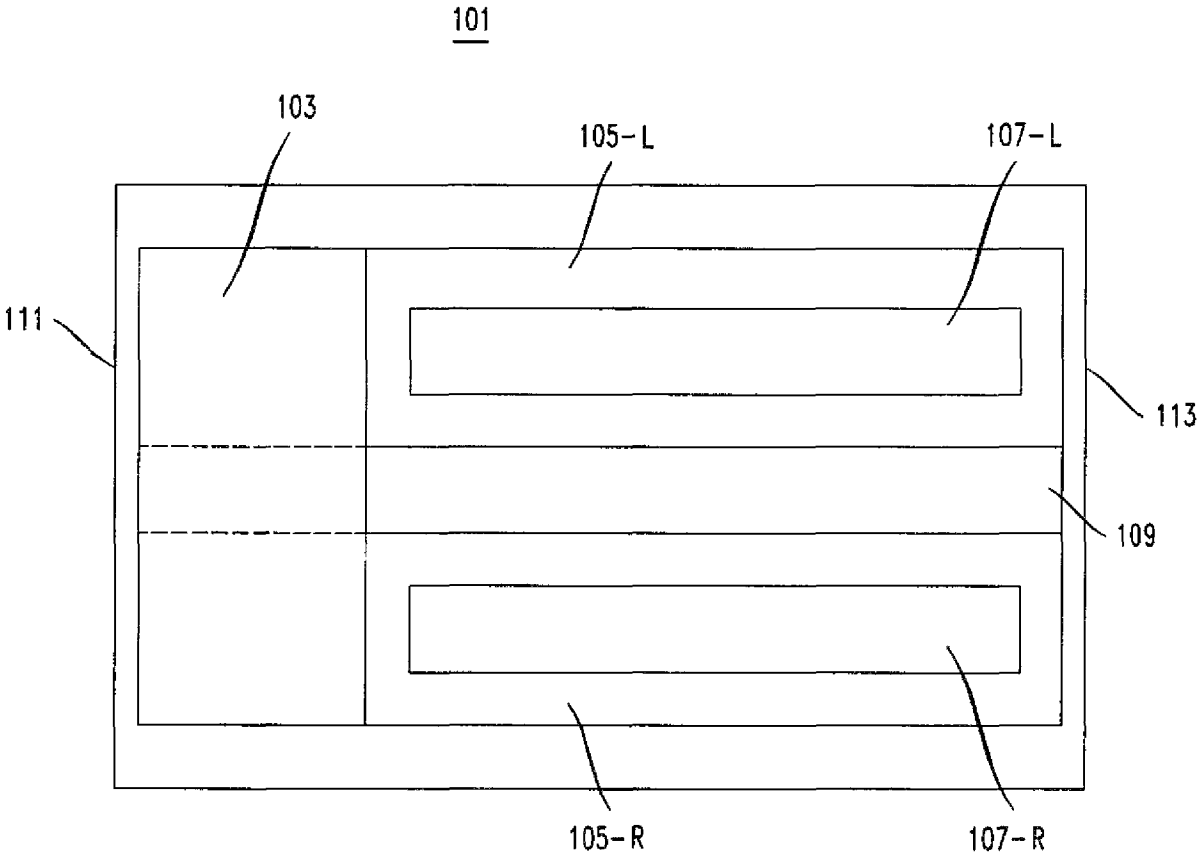
FIG. 1 shows a block representation of a top view of an illustrative antenna frame in accordance with the principles of the disclosure.

The following merely illustrates the principles of the disclosure. It will thus be appreciated that those skilled in the art will be able to devise various arrangements that, although not explicitly described or shown herein, embody the principles of the disclosure and are included within its spirit and scope. Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions. Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future.

It will be appreciated by those skilled in the art that any block diagrams herein represent conceptual views of illustrative circuitry or components embodying the principles of the disclosure.

Unless otherwise explicitly specified herein, the drawings are not drawn to scale. In the description, identically numbered components within different ones of the FIGS. refer to the same components.

The issues of installing new antennas for use on crowded sites, where the new antennas are needed to support a new, such as a next generation, wireless service, e.g., 5G, can be avoided, in accordance with the principles of the disclosure, by the use of an arrangement which interleaves an array of 5G antennas amongst multiband antenna structures. In accordance with an aspect of the disclosure, the multiband antenna structures may be passive antennas. In accordance with an aspect of the disclosure, the multiband antenna structures may be low band (LB) antennas. In embodiments of the disclosure, several of the multiband antenna structures may be arranged to perform within at least one of several bands, e.g., from about 700 MHz to about 960 MHz, from about 1710 MHz to about 2690 MHz and from about 1400 MHz to about 2400 MHz. In accordance with an aspect of the disclosure, the 5G antennas may be arranged as a massive multiple-input multiple-output (mMIMO) array. The mMIMO array may be an active array. In such a case, where the 5G antenna array is an active array and the LB antenna array is a passive array, the section of the overall antenna frame having a configuration with the 5G antenna array within the LB antenna array may be referred to as an active passive antenna (APA) arrangement.

Herein, the term 5G is meant to refer to the next generation of mobile networks as specified by the International Telecommunications Union-Radio communications sector (ITU-R), referred to as 4G standards which is well known to those of ordinary skill in the related art.

In accordance with an aspect of the disclosure, such an interleaved arrangement of antennas may employ low band (LB) antennas that are formed using conductive elements, including, for example, feeders and radiators, on thin supporting sheets. The supporting sheets are oriented so that at least one of their dimensions, e.g., their thinnest dimension, fits within the limited physical space between the 5G antennas. In accordance with an embodiment of the disclosure, one or more of the supporting sheets, which act as a substrate to which the conductive elements are affixed, may be, for example, a printed circuit board. The substrates may be arranged so as to generally appear to form four sides of a hollow rectangular parallelepiped, e.g., four sides of a hollow cuboid, which may have various protrusions and cutouts, where the missing two sides, which are open, may be considered to be the top and bottom sides of the cuboid, where the bottom side is closest to the plane from which the signals are supplied to the antennas. In other words, the substrates for the radiating elements of the LB antennas may be shaped to appear like an empty rectangular box with the top and bottom surfaces removed. The missing bottom surface is in the area from which the 5G antennas receive their signal to transmit, e.g., near the chassis level, and the lack of the opposing top surface allows signals from the 5G antennas to radiate outward. The low band (LB) radiating elements thus fit within the narrow interstices between radiating elements of a two-dimensional 5G antenna array.

FIG. 1 shows a block representation of a top view of an illustrative antenna frame 101 in accordance with the principles of the disclosure. Antenna frame 101 includes: a) interleaved multiband antenna structures+5G radiating antenna structure 103, in accordance with the principles of the disclosure; b) two LB antenna networks 105-L and 105-R, collectively LB antenna networks 105, which operate, for example, from about 0.7 GHz to about 0.96 GHz and which are made up of dual polarization antennas; c) two high band (HB) antenna networks 107-L and 107-R which operate, for example, from about 1.7 GHz to about 2.7 GHz and which are each placed "inside" the respective one of LB antenna networks 105 that has a matching reference designator suffix; and d) one HB antenna network 109 which operates, for example, from about 1.4 GHz to about 2.4 GHz, also known as central passive array 109. All of the networks may be variable electrical tilt (VET) capable. The overall antenna dimensions may be about 2090 mm×499 mm×215 mm. Note that by placed "inside" it is meant in an embodiment of the disclosure that the HB antennas of HB antenna networks 107 may be placed on top of and between the antennas of corresponding LB antenna networks 105. In embodiments of the disclosure, as indicated by the dashed lines, at least one of LB antenna networks 105 may continue all the way across antenna frame 101 by including as elements thereof at least one of the multiband antenna structures that is part of interleaved multiband antenna structures+5G radiating antenna structure 103. Note in this regard that the antenna elements within an LB antenna networks 105 need not all be of the same type or structure. For example, in an embodiment of the disclosure, one of LB antenna networks 105 may be made up of 8 LB elements where one is a patch alone, 5 are a patch with 'L' elements positioned on top of them, and 2 are multiband antenna structures interleaved with 5G dipoles in accordance with the principles of the disclosure. In embodiments of the disclosure, all the antennas of one of LB antenna networks 105 may be fed using the same LB feeding network.

Designs comprising a similar sized chassis and configured similarly except for the space occupied by interleaved LB+5G radiating antenna structure 103 being occupied only by a 2×2 LB antenna arrays, would leave no space on the frame for additional 5G antennas. As such, there is no space, for example, for an additional 8×8×2 3.5 GHz active antenna array, where the "2" indicates that the antennas of the 5G antenna array provide for dual polarization.

Figure 2:
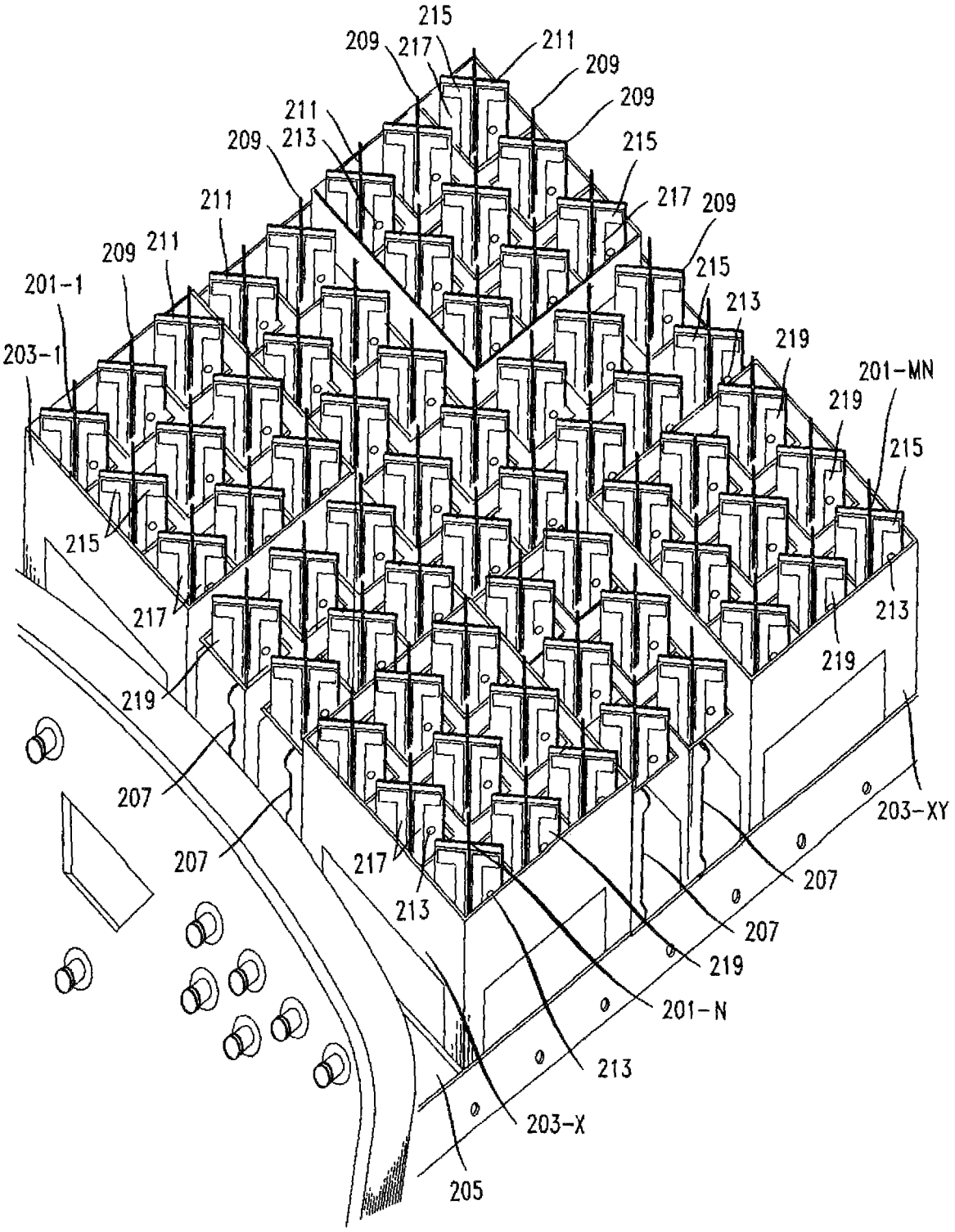
FIG. 2 shows an illustrative perspective view of a section of an interleaved LB+5G radiating antenna structure, in accordance with the principles of the disclosure.

FIG. 2 shows an illustrative perspective view of a section of interleaved LB+5G radiating antenna structure 103, in accordance with the principles of the disclosure. Shown in FIG. 2 are N×M 5G radiating antennas elements 201-1 to 201-NM, which may be referred to individually as a 5G antenna 201 and collectively as 5G antennas 201. This array may be a 5G mMIMO N×M×2 antenna array where N is an integer greater than or equal to 1 that corresponds to the number of columns of antennas, M is an integer greater than or equal to 1 that corresponds to the number of rows of antennas, and 2 corresponds to the number of cross polarized channels per antenna 201, e.g., when each antenna 201 is a dual polarized antenna made up of two dipoles.

In FIG. 2, both N and M are equal to 8, so there are 64 antennas arranged as an 8×8 antenna matrix and when each antenna is a dual polarized antenna the result is a 128 element mMIMO array. The 5G array may be, for example, functional from about 3.3 GHz to about 3.7 GHz or from about 3.4 GHz to about 3.8 GHz. As will be readily understood by those of ordinary skill in the art, other variously dimensioned mMIMO arrays may be employed, e.g., that correspond to other central frequencies, such as, 700 MHz or 2.5 GHz. In accordance with an aspect of the disclosure, the 5G antenna array may be an active antenna array.

Also shown in FIG. 2 is an array of multiband antennas, which, as shown in FIG. 2 are an array of low band antennas 203-1 to 203-XY, where X is an integer greater than or equal to 1 that corresponds to the number of columns of antennas 203 and Y is an integer greater than or equal to 1 that corresponds to the number of rows of antennas 203, which may be referred to individually as an LB antenna 203 and collectively as LB antennas 203. LB antennas 203 may operate from about 0.7 GHz to about 0.96 GHz. As will be readily understood by those of ordinary skill in the art, other frequency bands may be employed. LB antennas 203 are interleaved, or interspersed, amongst 5G antennas 201. Of course, it may be considered that 5G antennas 201 are interleaved or interspersed amongst LB antennas 203.

Advantageously, in accordance with an aspect of the disclosure, LB antennas 203 are designed so that they can fit within the spacing between 5G antennas 201. In the example of the disclosure shown in FIG. 2, antennas 203 have a hollow cuboid shape where two opposing faces of the cuboid are missing. One of the missing faces is proximal to chassis 205 of the antenna frame of which 5G antennas 201 and LB antennas 203 are a part, e.g., the chassis of antenna frame 101 (FIG. 1) while the other missing face is distal to the chassis of the antenna frame, e.g., in the manner shown in FIG. 2. Another way to think about LB antennas 203 is that they are akin to a rectangular ribbon that is added to surround one or more of 5G antennas 201. Thus, LB antennas 203 may be viewed as having been "slipped in" amongst a preexisting array of 5G antennas 201 and each LB antenna 203 surrounds one or more of 5G antennas 201.

LB antennas 203 are arranged in a 2×2 array in the embodiment of the disclosure shown in FIG. 2. In embodiments of the disclosure, the physical dimensions of each of the LB antennas 203 may be substantially the same, e.g., in the manner shown in FIG. 2. In the illustrative embodiment of FIG. 2, there are nine 5G antennas within the space defined by one of LB antennas 203. In the embodiment of FIG. 2, there are also two rows of three 5G antennas between each adjacent pair of LB antennas 203.

In an embodiment of the disclosure to be discussed in conjunction with FIG. 2, 5G antennas 201 are configured to form an active array while LB antennas 203 are employed as a passive array. As noted above, such a configuration may be referred to as an active passive antennas (APA) arrangement. However, as will be recognized by those of ordinary skill in the art, such need not be a limitation but rather 5G antennas 201 may be used passively while LB antennas 203 may be used actively. The various possible combinations and arrangements are at the implementer's discretion.

Advantageously, the interleaved antenna array structure can be used as a replacement for a previously installed antenna array of the same size while providing enhanced or additional functionality. Thus, interleaved LB+5G radiating antenna structure 103 can be substituted in a place on a chassis that previously only had an LB antenna array. This allows an active 5G functionality to be added to a frame without losing the previously only available LB functionality that was located within the space that now provides the 5G functionality.

One type of antenna radiating element that is generally suitable to be used as 5G antennas is generally described in United States Patent Publication 2012/0146872 of Chainon et al. which was published on Jun. 14, 2012 and is incorporated herein by reference. As will be readily understood by those of ordinary skill in the art, other types of antennas, including patch, other configurations of dipoles, or any other high band antenna and even combinations thereof, may be employed as the 5G antennas.

In accordance with an aspect of the disclosure, 5G antennas 201 may be located atop pillars, e.g., pillars 207 so that they are offset from chassis 205 so as to bring them to an appropriate height, e.g., with respect to the "tops" of LB antennas 203, which are the portions thereof distal from chassis 205. Thus, the 5G antennas may have their "tops" below, at the same level as, or above the plane of the missing top surface of LB antennas 203. Each of pillars 207 couples signals between 5G antennas 201 and radio circuitry (not shown) that may be located below chassis 205. Advantageously, the array of 5G antennas 201 may be placed to best effect, e.g., to minimize potential radio frequency (RF) interactions between the 5G antennas 201 and any other antenna arrays existing within the same overall antenna envelope at the site. Although often convenient or advantageous to be so arranged, not all of 5G antennas 201 need be at the same height.

In accordance with an aspect of the disclosure, filter elements may be added to each of the antennas, or subgroups of antennas, in order to prevent potential damaging interactions from any existing radio networks with 5G antennas 201, as well as, or in the alternative, to protect any existing radio networks from potential spurious energy that might be emitted or received by 5G antennas 201. In accordance with a further aspect of the disclosure, such filter elements may be incorporated into pillars 207.

Figure 5:
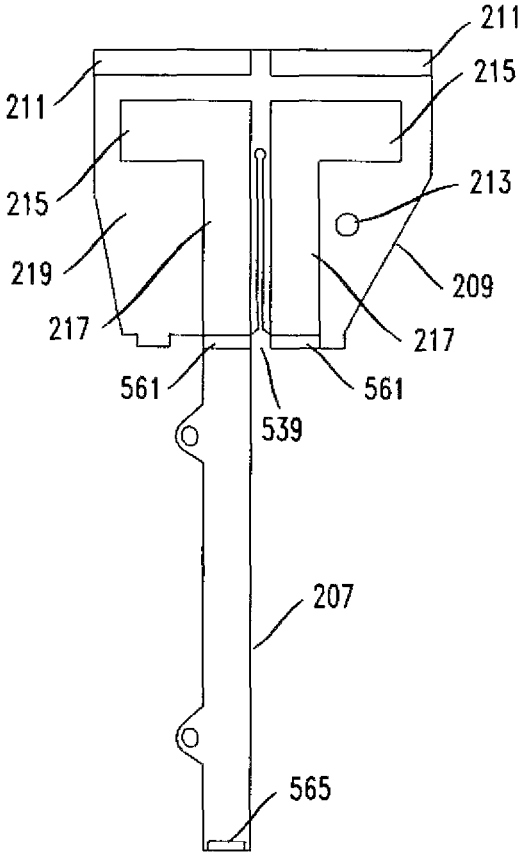
FIGS. 5 and 6 show first and second faces of a circuit board on which is formed a dipole antenna that is part of a 5G antenna along with a portion of a stand.

Each of antennas 201 in the embodiment of FIG. 2 may be a dual polarized structure composed of two dipoles. Each dipole may be formed on a circuit board 209 and two circuit boards are coupled together, e.g. at 90 degree angles, e.g., by using slits in one or more of the circuit boards to fit them together, which is well-known. Such slits, are shown more clearly in FIGS. 5-8, e.g., slit 539 shown in FIGS. 5 and 6, and slit 739 shown in FIGS. 7 and 8. Due to the perspective of FIG. 2, only one of the two circuit boards 209 that make up each dipole is easily visible while the other of the two circuit boards is only seen edge on. Furthermore, for each antenna 201 FIG. 2 only shows one of the faces, face 219, of each of the clearly visible circuit boards 209. Face 219 is also shown in FIG. 5. The opposite face of the clearly visible circuit boards 209 is shown in FIGS. 3 and 6 and discussed hereinbelow.

Face 219 of each of circuit boards 209 that is shown in FIG. 2 and FIG. 5 has thereon a pair of conductors 215 that act as radiating elements, and hence may be referred to as 5G radiating elements 215, and together each pair of conductors 215 makes up a dipole antenna. More specifically, each pair of conductors 215 defines a radiating line. Each of 5G radiating elements 215 is electrically coupled to one of conductors 217. Coupled 5G radiating elements 215 and conductors 217 may be oriented at right angles to each other. This may form an "L" shape that is upside down, or reversed and upside down, given the orientation of FIGS. 2 and 5 with respect to chassis 205, which is considered to be on the bottom. Each of conductors 217 may be considered a base and conductors 215 may be considered an arm.

Figure 7:
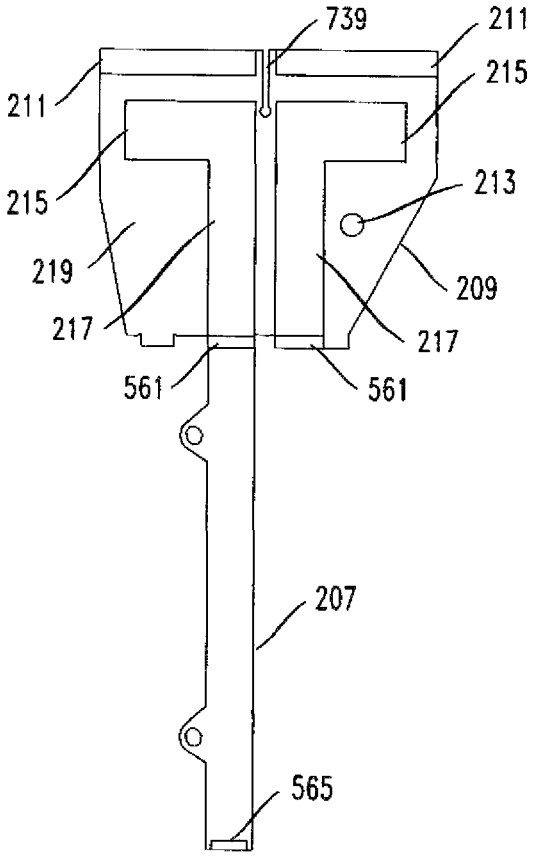
FIGS. 7 and 8 show first and second faces of a circuit board on which is formed a dipole antenna that is part of a 5G antenna along with a portion of a stand, the circuit board of FIGS. 7 and 8 being suitable to be mated orthogonally to the circuit board of FIGS. 5 and 6.

Both of conductors 217 are electrically coupled to ground. The ground is fed via a pillar 207 from a ground plane on chassis 205. Such a ground plane is seen in FIG. 4. One of conductors 217 may be electrically coupled to a pillar 207 at one of connection points 561 (FIGS. 5 and 7). Connection points 561 also couple pillar 207 and conductors 217 to a reflector discussed hereinbelow in connection with FIG. 3, which thus acts as a ground plane.

Figure 6:
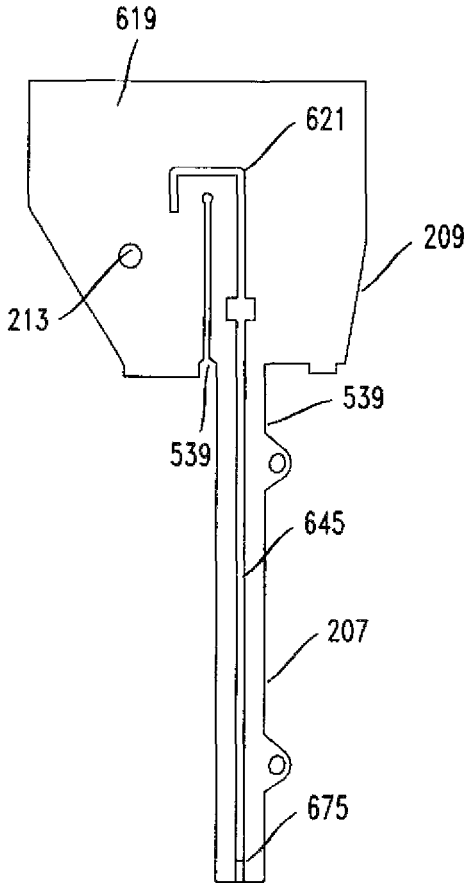

On the face of a circuit board 209 opposite to face 219, which is shown in FIG. 6 as face 619, is conductive line 621 that feeds the dipole made of the two 5G radiating elements 215. Conductive line 621 is shaped like an upside-down "J" so that it crosses over the gap between paired radiating elements 215 on opposite face 219. Conductive line 621 may be fed from stripline 645 via its pillar 207. As can be seen in FIG. 6, conductive line 621 is electrically coupled to stripline 645, e.g., using a solder connection or other such well known method.

Thus, together, 5G radiating elements 215 make up a half-wave dipole made up of two half-dipoles separated by a gap which may be at least partially a slot. The dipole may be a stripline dipole.

Optional conductors 211 may be formed above 5G radiating elements 215 on each of circuit boards 209. Each of conductors 211 is not electrically connected to the dipole formed by the pair of radiating elements 215 on the same one of circuit boards 209 on which they are formed. Conductors 211 form another radiating line that is used to increase the gain and bandwidth of the dipole that is formed on the same one of circuit boards 209 with them. Conductors 211 may thus make up an optional so-called "director" or parasitic part that can be used for pattern shaping and for radiating element impedance matching. It is easier to see conductors 211 in FIGS. 5 and 7.

Holes 213 may be used to visibly distinguish between the two conductors.

Figure 8:
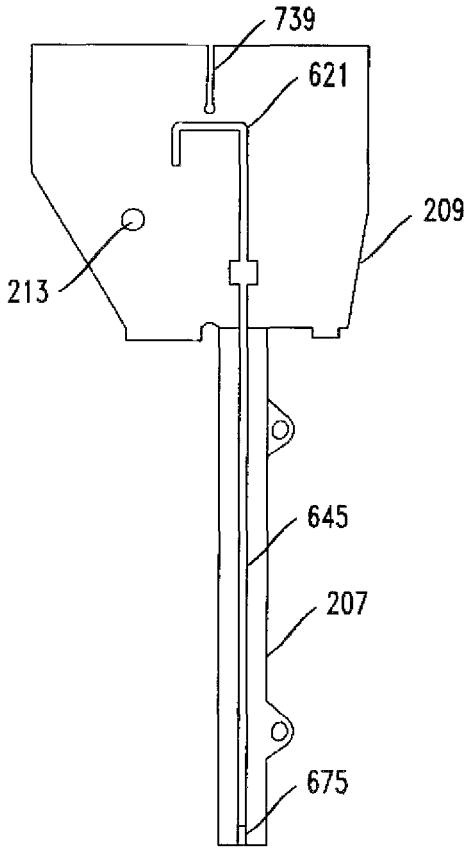

Each of circuit boards 209 that are only seen in FIG. 2 edge on may have a similar structure as described above for the easily visible circuit boards 209. As such, together two coupled orthogonal circuit boards 209 thus make up two dipoles that cross one another at ±45 degree orthogonal polarization. More specifically, FIGS. 7 and 8 show front and rear views of circuit boards 209 that are only seen in FIG. 2 edge on. The structures are substantially the same but for the location of their respective slit.

In one embodiment of the disclosure, the height of circuit boards 209 may be approximately 42 mm while their width is about 48 mm.

Figure 3A:
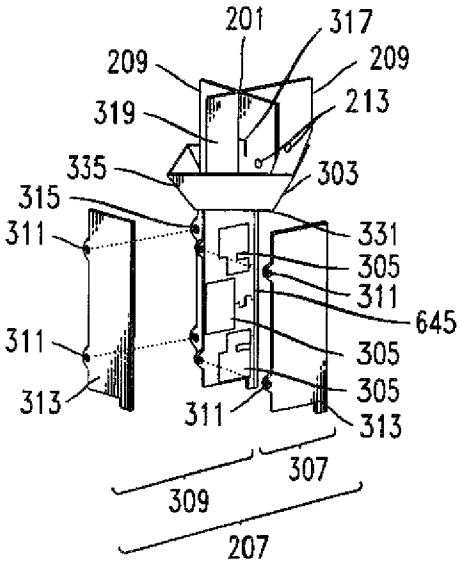
FIG. 3 is made up of FIGS. 3A, 3B, and 3C, each of which shows a different perspective view of an illustrative one of a 5G antenna when mounted on at least one pillar.
Figure 3B:
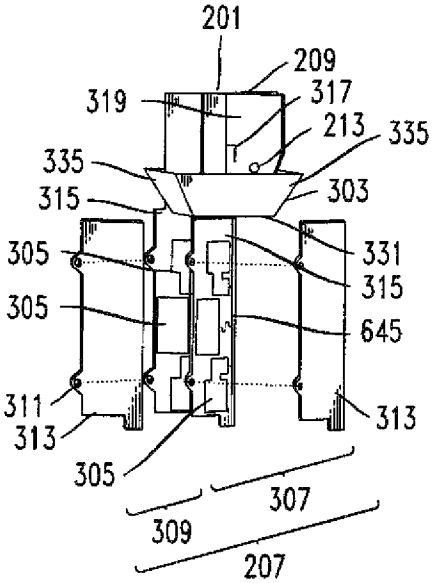
Figure 3C:
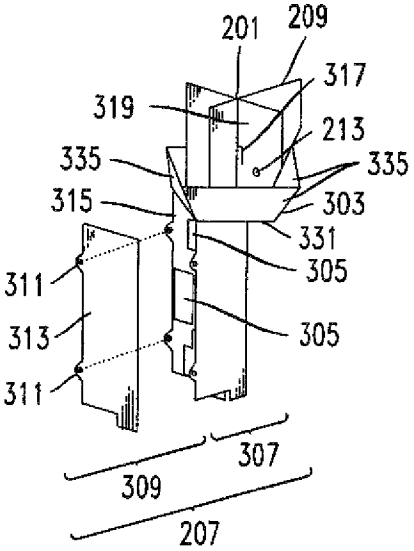
Figure 4:
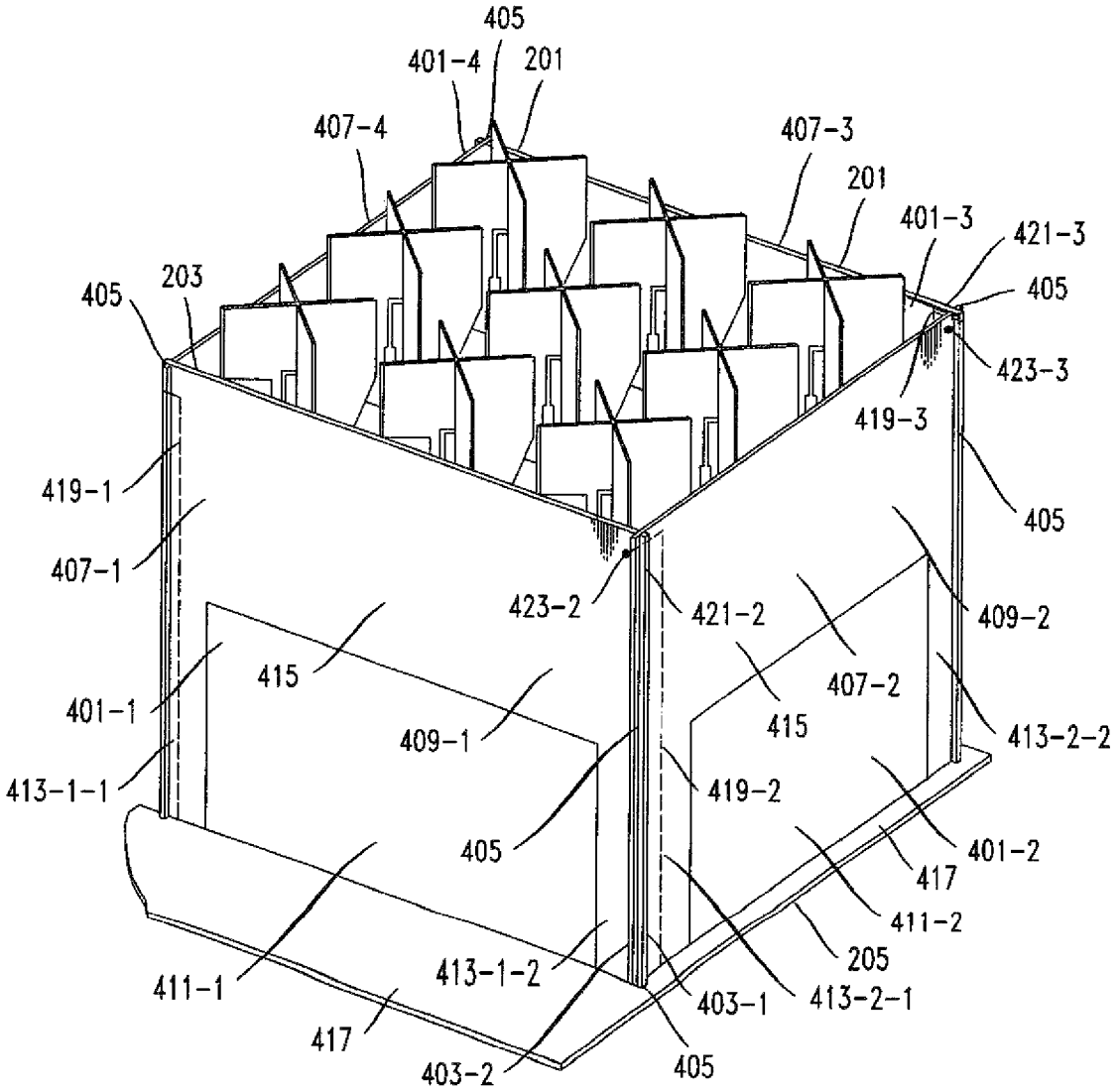
FIG. 4 shows an enlarged view of the structure of an illustrative LB antenna mounted on a chassis.

FIG. 3 is made up of FIGS. 3A, 3B, and 3C, each of which shows a different perspective view of an illustrative one of 5G antennas 201 when mounted on at least one pillar 207 which may also be referred to as a stand 207. The views of FIG. 3 enable seeing the opposite face of circuit boards 209 from face 219 shown in FIG. 2, e.g., face 619 of FIG. 6. For clarity and focus purposes, not all the details of 5G antennas 201 are shown in FIG. 3. As noted, the dipole is fed by conductive line 621 which is on the opposite face of circuit boards 209 from face 219. Portion 317 of conductive line 621 is shown in the views of FIG. 3.

Below antenna 201 is reflector 303. In the illustrative embodiment shown in FIG. 3, reflector 303 has, in the manner shown, an open at its base, hollow, inverted, and truncated pyramidal shape. Flat portion 331 of reflector 303 may be a circuit board covered in a conductor. Angled sides 335 of the pyramid of reflector 303 may be made of conductive metal. Sides 335 may be one or more pieces of metal that are clipped together. Sides 335 of the pyramid may be electrically coupled to the conductor of circuit board 331 of reflector 303. Circuit board 331 may be coupled to ground via connection to the ground on pillars 207 at connection points 561 (FIGS. 5 and 7). Thus, reflector 303 may be grounded in its entirety.

One or more of pillars 207 may be used to provide a signal to be transmitted by 5G antenna 201 from the level of chassis 205 (FIG. 2) to antenna 201. Each pillar 207 may be made up of two half-stands 307 and 309 which in turn may each be made up of two printed circuit boards 313 and 315, each of which has one internal side face facing the other and one external side face that faces outwards when the half stands are assembled. Circuit boards 313 and 315 may be, for example, Taconic TLX PCBs, which are coupled together at holes 311, e.g., using glue, rivets, or some other suitable arrangement, as is known to those of ordinary skill in the art.

The external facing side of printed circuit boards 313 may be coated in a conductor, e.g., copper, to provide an electromagnetic shield. Similarly, the external facing side of printed circuit boards 315 may be coated in a conductor, e.g., copper, to provide an electromagnetic shield. This is also shown in the embodiments shown in FIGS. 5 and 7. Also shown in the embodiments of FIGS. 5 and 7 is connection point 565 at which the conductor is electrically connected to ground, e.g., a ground plane, which is shown in FIG. 4. The internal side of printed circuit boards 313 may just be printed circuit board material. The internal side of printed circuit boards 315 may contain one or more conductors, e.g., stripline 645 (FIGS. 6 and 8), that may act as a feed for the signal to be transmitted by the 5G antenna 201 atop the stand. A connection point for stripline 645 with a signal from a signal source, which may be located below the ground plane, may be connection points 675 as shown in FIGS. 6 and 8. In the embodiments shown in FIGS. 6 and 8, the circuit board of pillar 207 on which connection points 675 are located may extend to below the ground plane shown in FIG. 4.

In an embodiment of the disclosure, e.g., as shown in FIG. 3, various filter elements 305 may be included on the internal surface of printed circuit boards 315 as part of stand 207. These filter elements may provide filtering, e.g., band pass (BP) filtering, for the supplied signals. Filter elements 305 may be a conductive, e.g., copper, regions on printed circuit boards 315.

In the embodiment shown, the filter is a 3 pole band pass stripline filter. The overall dimensions of the BP filter are about 60 mm×24 mm and based on the use of a sandwich of two Taconic TLX PCBs making up half stands 307 and 309 used as part of stand 207 where each PCB has a 0.762 mm thickness. A signal to be transmitted by an antenna 201 may be fed thereto, e.g., by stripline 645, that runs from the bottom of printed circuit boards 315 and is electrically coupled to a signal source which may be located below a ground plane that is on chassis 205. Again, such a ground plane is seen in FIG. 4.

In an alternative embodiment, a printed circuit board that has internal conductive planes available to it may be used in lieu of two separate printed circuit boards. For example, the outer two conductive planes may be used as ground planes while an internal conductive plane can be used for the feed line and filters.

Other types of filtering elements such as are known to those in the art may be employed on, within, or mounted to the pillars. For example, air cavity filters or ceramic filters may be employed. However, such filters typically add additional cost.

The design of such filtering elements must take into consideration several challenges including: 1) the fact that the number of radiating elements required may be very large; 2) the mechanical dimension of each filter element should be minimized while providing good RF performance; and 3) each filter needs to be connected directly to its respective radiating element port. Note that, for example, an 8×8 antenna array in which each radiating element is operating in dual polarization mode potentially leads to the use of, for example, 8×8×2=128 filters. Those of ordinary skill in the art will be able to select or design appropriate filters for their particular application.

Other types of antennas, stands, filters, and reflectors may be employed, without departing from the scope of the disclosure.

FIG. 4 shows an enlarged view of the structure of an illustrative LB antenna 203 (FIG. 2) mounted on chassis 205. In accordance with an aspect of the disclosure, LB antenna 203 may be a passive LB antenna. Also shown are ones of 5G antennas 201 that are located within LB antenna 203, in accordance with the principles of the disclosure. The faces of 5G antennas 201 shown in FIG. 4 are the opposite faces from those shown in FIG. 2 and so are better seen in FIGS. 6 and 8. For clarity and focus purposes, not all the details of 5G antennas 201 are shown in FIG. 4.

LB antenna 203 as shown in FIG. 4 may be made of four printed circuit boards (PCBs) 401-1 through 401-4, collectively circuit boards (PCBs) 401. PCBs 401 thus make up support walls for the radiating elements of LB antenna 203 and also may at least partially be used to support a feed structure to supply one or more signals to the radiating elements. Ones of printed circuit boards 401 may be joined, e.g., interlocked, at or near their respective edges. For example, a slit may be made in one of circuit boards 401 and an end portion of another, adjacent, one of circuit boards 401 passed there through. Thus, for example, end portion 403-1 of PCB 401-1 extends past the plane of PCB 401-2 while end portion 403-2 extends past the plane of PCB 401-1. Such, or similar techniques may be used at each corner 405 of LB antenna 203.

Although PCBs have been described hereinabove as the substrate, note that in other embodiments of the disclosure, any dielectric material, e.g., ceramic, glass, plastic, and so forth, that could be properly shaped and support properly shaped conductors may be employed as the substrate.

Portions of ones of external surfaces 407-1 through 407-4, i.e., external to the box, of respective ones of PCBs 401 are coated in a conductive material, e.g., copper. Thus, in the embodiment shown in FIG. 4, inverted "U" shaped conductors 409-1 through 409-4, collectively conductors 409, are formed on external surfaces 407-1 through 407-4 of respective ones of PCBs 401-1 through 401-4. Each of conductors 409 is made up of leg portions 413 and a radiating portion 415. More specifically, each conductor has two leg portions designated by an additional reference designation suffix. Thus, conductor 409-1 has leg portions 413-1-1 and 413-1-2 and radiating portion 415-1. Clearly depicted in FIG. 4 are conductors 409-1 and 409-2. However, note that, due to the orientation of LB antenna 203 in FIG. 4, surfaces 407-3 and 407-4, although they can be indicated, are not clearly visible and so conductors 409-3 and 409-4 are not visible in FIG. 4. Nevertheless, for purposes of the embodiment shown in FIG. 4, they each have thereon the same conductor structure as conductors 409-1 and 409-2.

Portions 411 of each of PCBs 401 that are not coated in conductive material are not necessary and may be eliminated, e.g., to reduce weight. Again, note that due to the orientation of LB antenna 203 removal of such unused portions of PCBs 401-3 and 401-4 could not be seen in FIG. 4 were such to be the case.

FIG. 4 also shows the upper portion of chassis 205, which may be ground plane 417. Such a ground plane was mentioned earlier. Various vias may be made through chassis 205 and ground plane 417 to enable signals to pass through to 5G antennas 201 and LB antennas 203.

Each of leg portions 413 of conductors 409 proximal to ground plane 417 is connected to ground plane 417.

On the rear face of PCBs 401 from leg portions 403, i.e., on the face opposite to conductors 409 which is interior to the box, is located one of conductive lines 419 that is used to feed signals to be radiated by LB antenna 203. Conductive lines 419 are shown dashed to indicate that they are on the rear, internal face and cannot be seen in the view of FIG. 4 due to its perspective except for the small portion of conductive line 419-3. Conductive line 419-1 is located behind leg 413-1-1, conductive line 419-2 is located behind leg 413-2-1, conductive line 419-3 is located behind leg 413-3-1 (not visible), and conductive line 419-4 (not visible) is located behind leg 413-4-1 (not visible).

Near the top of the one of PCBs 401, each of conductive lines 419 bends, e.g., at substantially 90 degrees, and extends to form arm portion 421 that extends toward the edge of the one of PCBs 401 on which it is formed. As such, arm portion 421 may extend through the interlocking adjacent one of PCBs 401. Arm portion 421 is then electrically coupled to conductor 409 of the adjacent, interlocked PCB 401 typically in the upper corner, e.g., at electrical coupling point 423. The electrical coupling may be by way of solder joint, via, conductive glue, or any similar or well known technique. Note that conductors 409 of adjacent PCBs 401 are not electrically connected in that there is no conductor between them. As an example, note that conductive line 419-2 is located behind leg 413-2-1. At the top of PCB 401-2 it bends towards PCB 401-1 through which it extends and is coupled to conductor 409-1 at electrical coupling point 423-3.

In an embodiment of the disclosure, each of conductive lines 419-1 and 419-3 may be coupled to the same signal source which may be located below the surface of chassis 205. Similarly, each of conductive lines 419-2 and 419-4 may be coupled to the same signal source which is different from the signal source coupled to conductive lines 419-1 and 419-3 but which may also be located below the surface of chassis 205. Thus, a dual polarized dipole is formed. Each of the individual dipoles so formed have a plus or minus 45 degree polarization.

Advantageously, due to the thinness of the walls, e.g., PCBs 401, upon which the conductive and radiating elements of LB antenna 203 are supported, the walls, and hence the conductive and radiating elements, can be fit in the interstitial spacing between adjacent ones of 5G antennas 201. This enables an efficient use of space, as a two-dimensional array of 5G antennas 201 can be interleaved among a two-dimensional array of LB antennas 203, e.g., as shown in FIG. 2, in accordance with the principles of the disclosure.

Herein, the term two-dimensional with regard to an array of antennas is to be understood to refer to the dimensions that form the array, for example in columns and rows, even though the elements forming such arrays, e.g. individual antenna structures present in the rows and columns, have three dimensions.

What is claimed is:

1. An antenna assembly, comprising:

a two-dimensional array of multiband antennas; and a two-dimensional array of fifth generation—5G-antennas for broadband cellular networks;

wherein:

at least some of the 5G antennas are interleaved amongst the multiband antennas;

each of one or more of the multiband antennas is shaped like a hollow parallelepiped with two opposing surfaces missing, wherein one of the missing surfaces is proximal to a source of a signal that is supplied to the multiband antenna to be transmitted therefrom and the opposing missing surface is distal to the signal source;

the hollow parallelepiped comprises four support walls each of which fits within a gap between at least two of the 5G antennas; and at least one of the support walls has a conductor for radiating therefrom.

2. The antenna assembly as defined in claim 1, wherein the hollow parallelepiped is a cuboid.

3. The antenna assembly as defined in claim 1 wherein the multiband antennas are low band (LB) antennas.

4. The antenna assembly as defined in claim 1 wherein the multiband antennas are passive antennas.

5. The antenna assembly as defined in claim 1 wherein the 5G antennas are arranged as an N×M×2 element array where N is an integer greater than or equal to 1 that corresponds to the number of columns of antennas, M is an integer greater than or equal to 1 that corresponds to the number of rows of antennas, and 2 corresponds to the number of cross polarized channels of each 5G antenna.

6. The antenna assembly as defined in claim 1 wherein at least one of the 5G antennas is mounted on a stand.

7. The antenna assembly as defined in claim 1 wherein at least one of the 5G antennas is mounted on a stand that feeds at least one signal to be radiated by the at least one 5G antenna to the at least one 5G antenna.

8. The antenna assembly as defined in claim 1 wherein at least one of the 5G antennas is mounted on a stand that feeds at least one signal to be radiated by the at least one 5G antenna to the at least one 5G antenna and wherein the stand incorporates a filter element through which the at least one signal passes.

9. The antenna assembly as defined in claim 1 wherein at least one of the 5G antennas is mounted above a reflector.

10. The antenna assembly as defined in claim 1 wherein at least one of the 5G antenna elements is mounted above a reflector that has an open at its base, hollow, truncated inverted pyramid shape.

11. The antenna assembly as defined in claim 1 wherein the 5G antennas are arranged as a massive multiple input multiple output (mMIMO) antenna array comprising at least 64 5G antennas.

12. The antenna assembly as defined in claim 1 wherein at least one of the 5G antennas is located within one of the multiband antennas and wherein at least one of the 5G antennas is located between two of the 5G antennas.

13. The antenna assembly as defined in claim 1, wherein:

the two-dimensional array of fifth generation—5G-antenna elements has a regular spacing between each of the 5G antenna elements; and at least some of the 5G antenna elements are interleaved amongst the multiband antenna structures such that support structures and radiators thereon for each of the two-dimensional array of multiband antenna structures fit within space provided by the regular spacing of the two-dimensional array of 5G antenna elements.

14. The antenna assembly as defined in claim 13 wherein each of the 5G antenna elements that are interleaved amongst the multiband antenna structures is spaced apart from at least one other said interleaved 5G antenna element by a thickness of an intervening one of said support structures of the multiband antenna structures.

15. The antenna assembly as defined in claim 1, wherein each of one or more of the multiband antennas comprises:

four printed circuit boards that are joined to form a hollow rectangular box with its top and bottom missing;

conductive material forming on a respective first surface of at least some of the printed circuit boards first and second vertical conductive legs and a horizontal radiating conductor therebetween, each of the vertical conductive legs being connected at their respective end distal from the horizontal radiating conductor to ground, each said first surface facing exteriorly to the hollow rectangular box;

a respective feed conductor formed on a second surface, opposite to said respective first surface, of the at least some of the printed circuit boards, each said second surface facing interiorly to the hollow rectangular box, each of the feed conductors being located opposite to the first vertical conductive leg and extending behind the first vertical conductive leg substantially a length of the first vertical conductive leg, each of the feed conductors being couplable to a signal source at an end thereof distal to the horizontal radiating conductor coupled to its first vertical leg; and a conductive connection between another end of each respective feed conductor and the horizontal radiating conductor of the one of the printed circuit boards immediately adjacent thereto.

16. The antenna assembly as defined in claim 15 wherein each respective conductive connection is located above a respective second leg.

17. The antenna assembly as defined in claim 1, wherein:

each of one or more of the multiband antennas comprises:

four printed circuit boards that are joined to form a hollow rectangular box with its top and bottom missing, each of said four printed circuit boards having, relative to the formed hollow rectangular box, an outwardly facing first surface and an inwardly facing second surface;

conductive material forming a horizontal radiating conductor on a respective first surface of each of at least some of the four printed circuit boards;

for each said horizontal radiating conductor, a respective feed conductor formed on the second surface of the printed circuit board on which the horizontal radiating conductor is formed, each of the feed conductors being couplable to a signal source; and a conductive connection between each horizontal radiating conductor and a respective feed conductor;

and wherein the printed circuit boards are joined so that at least a portion of each printed circuit board protrudes through at least one of its adjacent printed circuit boards.

18. The antenna assembly as defined in claim 17, wherein at least one fifth generation (5G) antenna is located within an area defined by the hollow rectangular box and wherein at least one 5G antenna is exterior to the area defined by the hollow rectangular box.

19. The antenna assembly as defined in claim 18 wherein the 5G antennas are part of a massive multiple input multiple output (mMIMO) active antenna array comprising at least 64 5G antennas.

20. The antenna assembly as defined in claim 18 wherein each of the 5G antenna elements that are interleaved amongst the multiband antenna structures is spaced apart from at least one other said interleaved 5G antenna element by a thickness of an intervening one of said printed circuit boards.

* * * * *